US009117617B2

(12) United States Patent
Russ, IV et al.

(10) Patent No.: US 9,117,617 B2
(45) Date of Patent: Aug. 25, 2015

(54) AXIAL MAGNETIC ION SOURCE AND RELATED IONIZATION METHODS

(71) Applicant: Agilent Technologies, Inc., Loveland, CO (US)

(72) Inventors: Charles William Russ, IV, Loveland, CO (US); Harry F. Prest, Loveland, CO (US); Jeffrey T. Kernan, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 85 days.

(21) Appl. No.: 13/925,623

(22) Filed: Jun. 24, 2013

(65) Prior Publication Data

US 2014/0375209 A1 Dec. 25, 2014

(51) Int. Cl.

| | |
|---|---|
| ***H01J 7/24*** | (2006.01) |
| ***H05B 31/26*** | (2006.01) |
| ***H01J 27/02*** | (2006.01) |
| ***H01J 27/20*** | (2006.01) |
| ***H01J 49/14*** | (2006.01) |

(52) U.S. Cl.

CPC ..... *H01J 27/024* (2013.01); *H01J 27/205* (2013.01); *H01J 49/147* (2013.01)

(58) Field of Classification Search

USPC ..... 315/111.91

See application file for complete search history.

(56) References Cited

U.S. PATENT DOCUMENTS

| | | | | |
|---|---|---|---|---|
| 3,924,134 | A | 12/1975 | Uman et al. | |
| 5,317,161 | A | 5/1994 | Chalupka et al. | |
| 5,340,983 | A * | 8/1994 | Deinzer et al. | 250/281 |
| 5,457,324 | A * | 10/1995 | Armour et al. | 250/492.21 |
| 5,493,115 | A * | 2/1996 | Deinzer et al. | 250/281 |
| 5,942,752 | A | 8/1999 | Wang | |
| 6,498,348 | B2 * | 12/2002 | Aitken | 250/396 ML |
| 7,060,987 | B2 | 6/2006 | Lee et al. | |
| 7,071,466 | B2 * | 7/2006 | Glukhoy | 250/287 |
| 7,259,019 | B2 * | 8/2007 | Pawliszyn et al. | 436/178 |
| 7,291,845 | B2 | 11/2007 | Moeller et al. | |
| 7,683,314 | B2 * | 3/2010 | Green et al. | 250/288 |
| 7,807,963 | B1 * | 10/2010 | Bier | 250/283 |
| 8,395,112 | B1 * | 3/2013 | Bier | 250/281 |
| 2002/0043621 | A1 * | 4/2002 | Aitken | 250/281 |
| 2005/0230614 | A1 * | 10/2005 | Glukhoy | 250/287 |

(Continued)

FOREIGN PATENT DOCUMENTS

| | | | |
|---|---|---|---|
| JP | S60240039 | A | 2/1985 |
| RU | SU 1 308 091 | A | 6/1988 |
| WO | 2014/099430 | A1 | 6/2014 |

OTHER PUBLICATIONS

Search Report for GB1411010.0 mailed Dec. 30, 2014.

(Continued)

*Primary Examiner* — Douglas W Owens
*Assistant Examiner* — Srinivas Sathiraju

(57) ABSTRACT

An ion source is configured for electron ionization and produces coaxial electron and ion beams. The ion source includes an ionization chamber along an axis, a magnet assembly configured for generating an axial magnetic field in the ionization chamber, an electron source, and a lens assembly configured for directing the ion beam out from the ionization chamber along the axis, reflecting the electron beam back toward the electron source, and transmitting higher energy ions out from the ion source while reflecting lower energy ions toward a lens element for neutralization.

20 Claims, 9 Drawing Sheets

(56) References Cited

U.S. PATENT DOCUMENTS

| | | | | |
|---|---|---|---|---|
| 2005/0276727 | A1* | 12/2005 | Pawliszyn et al. | 422/99 |
| 2007/0284521 | A1* | 12/2007 | Green et al. | 250/283 |
| 2013/0103337 | A1* | 4/2013 | Eiler | 702/86 |
| 2014/0097338 | A1* | 4/2014 | Eiler | 250/282 |
| 2015/0028222 | A1* | 1/2015 | Denning et al. | 250/424 |

OTHER PUBLICATIONS

Finkelstein, Theodore A.; A High Efficiency Ion Source; The Review of Scientific Instruments; Mar. 1940; vol. 11; pp. 94-97.

Carlston, C.E., et al.; High Efficiency Low-Pressure Ion Source; The Review of Scientific Instruments; Sep. 1962; vol. 33, No. 9; pp. 905-911.

Koontz, S.L., et al.; A Very High Yield Electron Impact Ion Source for Analytical Mass Spectrometry; International Journal of Mass Spectrometry and Ion Physics; 1981; vol. 37; pp. 227-239.

Dekieviet, M., et al.; Design and Performance of a Highly Efficient Mass Spectrometer for Molecular Beams; The Review of Scientific Instruments; May 2000; vol. 71, No. 5; pp. 905-991.

Yue, B., et al.; Electron Ionization in Superimposed Magnetic and Radio Frequency Quadrupolar Electric Fields; Anal Chem; 2005; vol. 77; pp. 4160-4166.

Yue, B., et al.; Superimposition of a Magnetic Field Around an Ion Guide for Electron Ionization Time-of-Flight Mass Spectrometry; Anal Chem; 2005; vol. 77; pp. 4167-4175.

Chang, J., et al.; Effect of Magnetic Field in Electron-Impact Ion Sources and Simulation of Electron Trajectories; The Review of Scientific Instruments; 2006; vol. 77; 085107.

Kalinin, A.V., et al.; Ion Source with Longitudinal Ionization of a Molecular Beam by an Electron Beam in a Magnetic Field; Instruments and Experimental Techniques; 2006; vol. 49, No. 5; pp. 709-713.

Alderwick, A.R., et al.; The Review of Scientific Instruments; 2008; vol. 79, 123301.

Ahn, et al.; Measurement of Ion Kinetic-energy Distributions in Electron-impact Ion Sources of a Quadrupole Mass Spectrometer; Journal of the Korean Physical Society; vol. 59, No. 4; Oct. 2011; pp. 2670-2675.

European Search Report for EP14 167 844.1 dated Mar. 2, 2015.

* cited by examiner

AXIAL MAGNETIC ION SOURCE AND RELATED IONIZATION METHODS

TECHNICAL FIELD

The present invention relates to ion sources utilizing an electron beam, such as may employed in mass spectrometry, and more particularly to ion sources producing an ion beam coaxial with the electron beam.

BACKGROUND

A mass spectrometry (MS) system in general includes an ion source for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to deter the molecular structures of components of the sample, thereby enabling the sample to be qualitatively and quantitatively characterized.

One example of an ion source is an electron ionization (EI) source. In a typical EI source, sample material is introduced into a chamber in the form of a molecular vapor. A heated filament is employed to emit energetic electrons, which are collimated and accelerated as a beam into the chamber under the influence of a potential difference impressed between the filament and an anode. The sample material is introduced into the chamber along a path that intersects the path of the electron beam. Ionization of the sample material occurs as a result of the electron beam bombarding the sample material in the region where the sample and electron paths intersect. The primary reaction of the ionization process may be described by the following relation: $M+e^{-}\rightarrow M^{*+}+2e^{-}$, where M designates an analyte molecule, $e^{-}$ designates an electron, and $M^{*+}$ designates the resulting molecular ion. That is, electrons approach a molecule closely enough to cause the molecule to lose an electron by electrostatic repulsion and, consequently, a singly-charged positive ion is formed. A potential difference is employed to attract the ions formed in the chamber toward an exit aperture, after which the resulting ion beam is accelerated into a downstream device such the mass analyzer or first to an intervening component such as an ion guide, mass filter, etc.

In the widely used cross-beam, or Nier-type, EI source, the ion beam is generated in a direction orthogonal the electron beam. This type of design is prone to loss of ions, due to a large number of ions being drawn out to the filaments or defocused and neutralized (lost) upon collision with the inner surfaces of the ionization chamber of the EI source. For many applications, it would be more advantageous to generate an on-axis electron beam, i.e., an electron beam that is coaxial with the resulting ion beam and with the downstream device into which the ions are transmitted such as, for example, a quadrupole mass filter. An axial electron beam may be much more likely to create ions that would have a much higher likelihood of success of being transferred into the downstream device from the EI source.

Therefore, there is a need for ion sources that produce ion beams coaxial with the electron beams that induce ionization, with reduced ion loss.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion source includes: a body including an ionization chamber and a sample inlet leading into the ionization chamber, the ionization chamber including a first end and a second end, and having a length along a source axis from the first end to the second end; a magnet assembly surrounding the body and configured for generating an axial magnetic field in the ionization chamber; an electron source positioned at the first end and including a thermionic cathode and an electron reflector, the electron source configured for accelerating an electron beam through the ionization chamber along the source axis; and a lens assembly comprising an extractor positioned at the second end, a first lens element outside the ionization chamber and spaced from the extractor along the source axis, and a second lens element spaced from the first lens element along the source axis, wherein the extractor is configured for directing an ion beam out from the ionization chamber along the source axis, the first lens element is configured for reflecting the electron beam toward the electron source, and the second lens element is configured for transmitting higher energy ions while reflecting lower energy ions toward the first lens element.

According to another embodiment, an ion processing system includes an ion processing device communicating with the lens assembly.

According to another embodiment, a method for performing electron ionization includes: directing electrons as an electron beam from an electron source through an ionization chamber having a length along a source axis between the electron source and extractor lens assembly; focusing the electron beam along the source axis by applying an axial magnetic field to the ionization chamber; reflecting the electrons back and forth along the source axis between the electron source and the lens assembly; producing ions by directing a sample material into the ionization chamber toward the electron beam, wherein the ions are focused into an ion beam along the source axis; transmitting the ions through the lens assembly along the source axis; and reflecting ions trapped in the lens assembly to prevent the trapped ions from exiting the lens assembly, while transmitting non-trapped ions out from the lens assembly.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
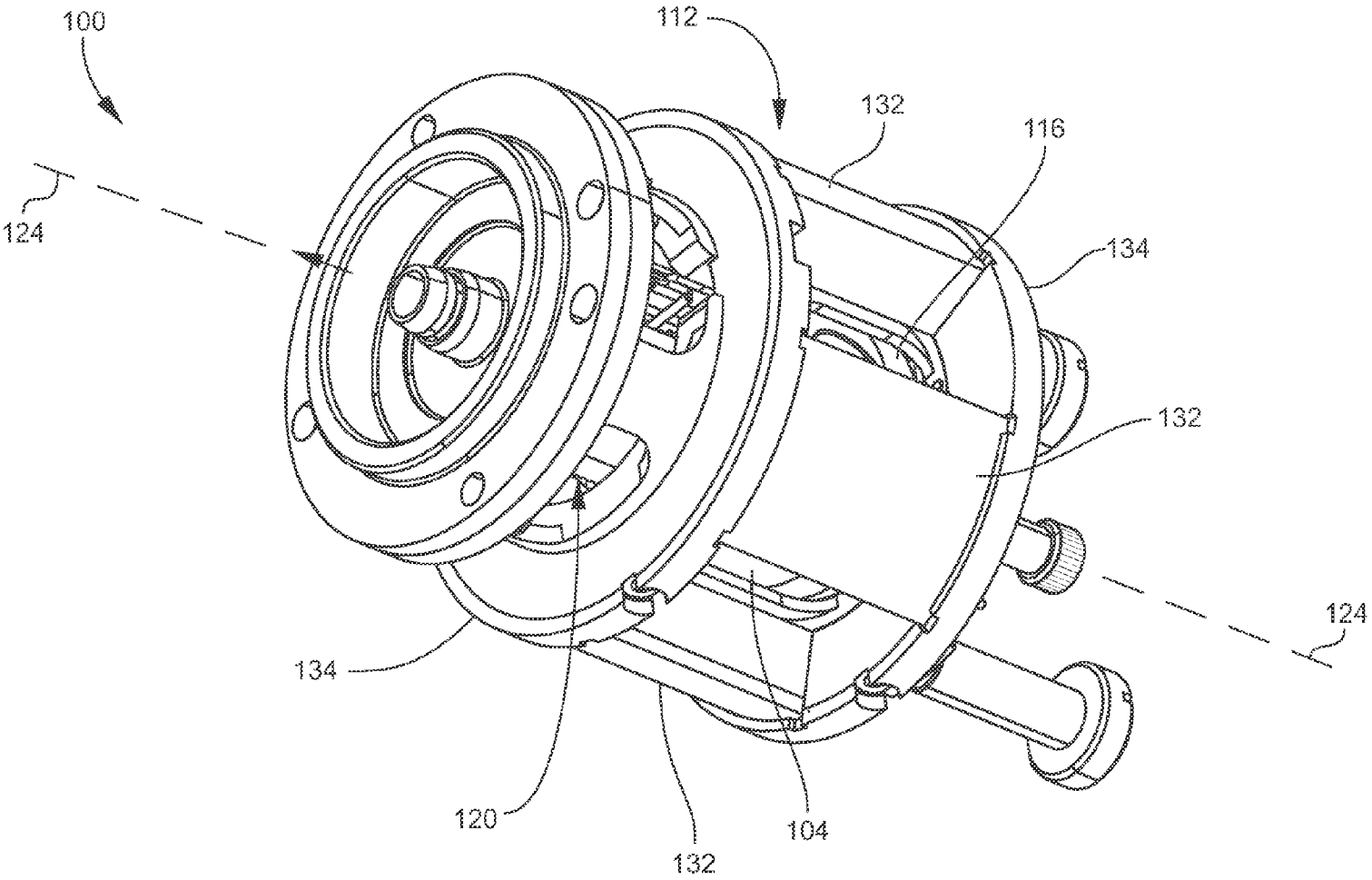
FIG. 1 is a perspective view of an example of an ion source according to some embodiments.
Figure 2:
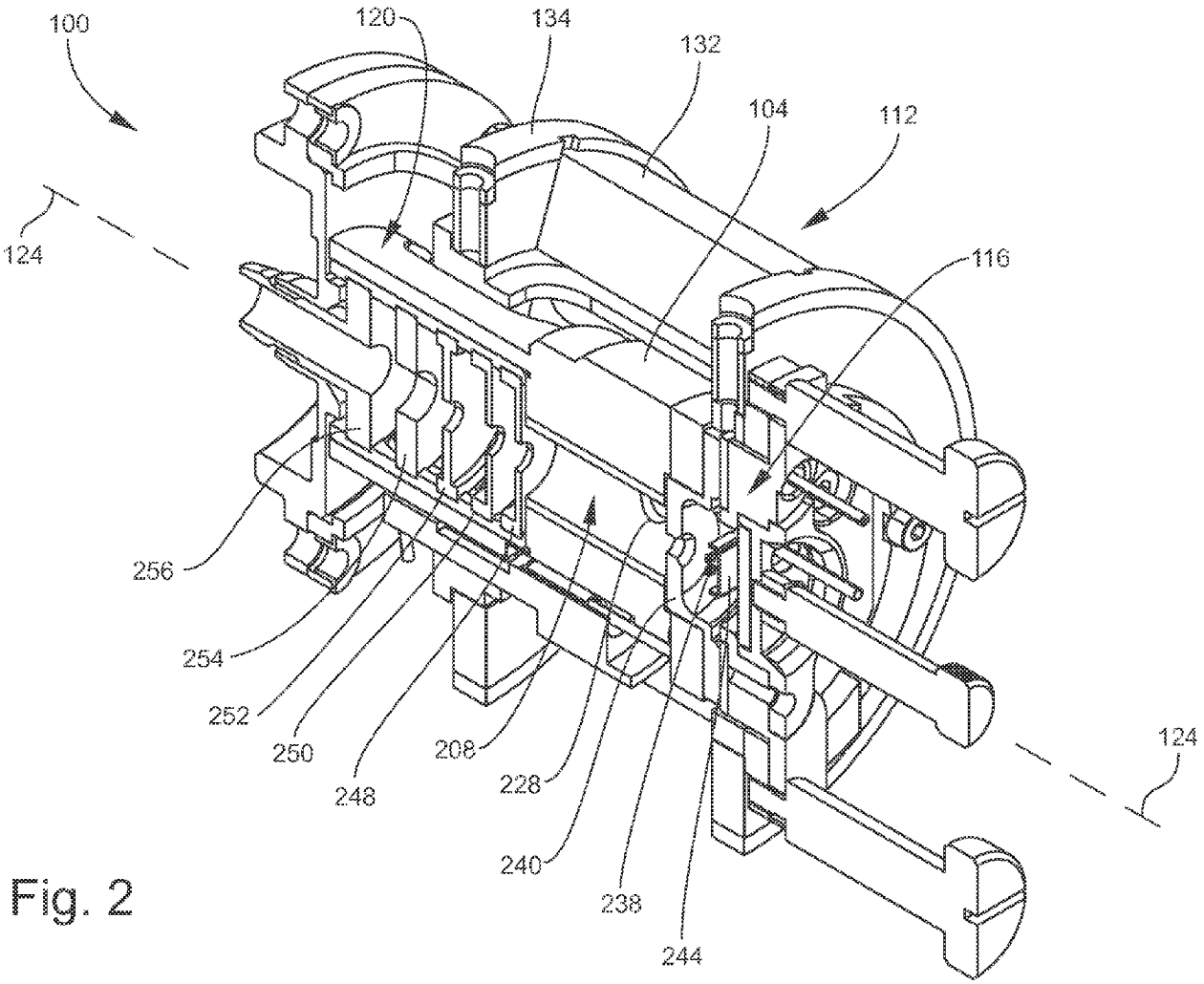
FIG. 2 is a perspective cross-sectional view of the ion source illustrated in FIG. 1.

FIG. 1 is a perspective view of an example of an ion source 100 according to some embodiments. FIG. 2 is a perspective cross-sectional view of the ion source 100 illustrated in FIG. 1. In the illustrated embodiment, the ion source 100 generally includes a body 104 defining an internal ionization chamber or volume 208, a magnet assembly 112, an electron source 116, and a lens assembly 120.

The ion source 100 may have an overall geometry or configuration generally arranged about a source axis 124. In operation, the ion source 100 produces an electron beam along the source axis 124, and may admit a stream of sample material to be ionized in any direction relative to the source axis 124. The sample material to be analyzed may be introduced to the ion source 100 by any suitable means, including hyphenated techniques in which the sample material is the output of an analytical separation instrument such as, for example, a gas chromatography (GC) instrument. The ion source 100 subsequently produces ions and focuses the ions into an ion beam along the source axis 124. The ions exit the ion source 100 along the source axis 124 and enter the next ion processing device, which may have an ion entrance along the source axis 124.

The ionization chamber 208 has a length along a source axis 124 from a first end to a second end. A sample inlet 228 is formed through the body 104 at any suitable location to provide a path for directing sample material from a sample source into the ionization chamber 208 where the sample material interacts with the electron beam. The axial length of the ionization chamber 208 may be selected to provide a relatively long viable electron beam region available to ionize the desired analyte molecules, thereby increasing the ionization efficiency of the ion source 100 and consequently the sensitivity of the instrument as a whole.

The magnet assembly 112 coaxially surrounds the body 104. The magnet assembly 112 is configured for generating a uniform axial magnetic field in the ionization chamber 208, which focuses and compresses the electron beam and the resulting ion beam along the source axis 124. The magnetically constrained electron beam and relatively long ionization chamber 208 may enable the generation of an ion beam well suited for improved extraction (emittance) out from the ionization chamber 208 and ultimately into a downstream ion processing device such as, for example, a mass analyzer, or another type of device that precedes the mass analyzer, such as an ion guide, an ion trap, a mass filter, a collision cell, etc. The ion beam may be extracted without suffering the ion losses known to occur in Nier-type ion sources, where a large number of ions are drawn out to the filaments or are defocused and neutralized (lost) upon collision with the inner surfaces of the ionization chamber 208. The magnet assembly 112 may include a plurality of magnets 132 circumferentially spaced from each other about the source axis 124. The illustrated embodiment includes a symmetrical arrangement of four magnets 132 that are affixed to ring-shaped yokes 134. The magnets 132 may be permanent magnets or electromagnets. The sample inlet 228, and other components such as electrical conduits, may be positioned in the gap between any pair of adjacent magnets 132. The magnets 132, although spaced from each other by gaps, are symmetrically arranged about the source axis 124 and the axial magnetic field generated is uniform.

The electron source 116 may be any device configured for producing electrons and directing an electron beam through the ionization chamber 208 from the first end. In the illustrated embodiment, the electron source 116 includes one or more cathodes 238. The cathode 238 is configured for thermionic emission, and thus may be or include one or more filaments (or alternatively coatings on cores) composed of a thermionically emissive material such as, for example, rhenium or tungsten-rhenium alloy. The cathode 238 is heated to a temperature sufficient to produce thermionic emission. Heating is typically done by running an electrical current through the cathode 238. The current may be adjusted to adjust the electron energy, which is typically set to around 70 eV but may be lower or higher. The electron source 116 also includes an ion repeller 240 and an electron reflector 244 (plate or electrode). The cathode 238 is positioned between the electron reflector 244 and the ion repeller 240 in what may be considered as an electron source region separated from the ionization chamber 208 by the ion repeller 240. The ion repeller 240 (which may also be considered to be an electron extractor) may be configured as a wall or plate having an aperture on the source axis 124. The electron energy is set by the voltages applied to the ion repeller 240 and the electron reflector 244. A voltage applied to the electron reflector 244 accelerates the as-generated electrons toward the lens assembly 120. For this purpose, an axial voltage gradient may be applied between the electron reflector 244 and any suitable conductive element (anode) downstream of the cathode 238, such as an "extractor" of the lens assembly 120 as described below. The voltage applied to the electron reflector 244 is typically negative but more generally is less positive than the ion repeller 240 and other downstream optics up to a "first lens element" of the lens assembly 120, described below. The electron reflector 244 and cathode 238 may be operated at equal potentials, or the electron reflector 244 may be more negative than the cathode 238 to assist in repelling electrons into the ionization chamber 208.

The lens assembly 120 is positioned at the second end of the ionization chamber 208, axially opposite to the electron source 116. The lens assembly 120 is configured, among other things, for directing an ion beam out from the ionization chamber 208 along the source axis 124 and into the next ion processing device. For this purpose, the lens assembly 120 includes a plurality of lens elements (or electrodes) independently addressable by voltage sources. Each lens element may have an aperture or slot on the source axis 124. In the illustrated embodiment, the lens assembly 120 includes an ion extraction lens (or ion extractor) 248, a first lens element (or electron reflector) 250 spaced from the extractor 248 along the source axis 124, a second lens element (or ion reflector) 252 spaced from the first lens element 250 along the source axis 124, and an ion source exit lens element (or ion beam focusing lens element) 256 spaced from the second lens element 252 along the source axis 124. The ion source exit lens element 256 may be configured or also serve as the entrance lens element into an ion processing device. The lens assembly 120 may also include one or more additional ion focusing lens elements 254 between the second lens element 252 and the ion source exit lens element 256, which may be utilized for focusing the ion beam. The ion repeller 240 and the extractor 248 may be considered as being the axial first and second ends, respectively, of the ionization chamber 208. As appreciated by persons skilled in the art, a voltage of appropriate magnitude may be applied to the extractor 248 to assist in drawing the ion beam out from the ionization chamber 208.

The first lens element 250 is positioned just outside the ionization chamber 208, and is directly adjacent to the extractor 248 on the downstream side thereof. A voltage of appropriate magnitude may be applied to the first lens element 250 to reflect the electron beam back into the ionization chamber 208. Accordingly, the cathode 238 (or the cathode 238 and electron reflector 244) and the first lens element 250 cooperatively work to reflect the electron beam back and forth through the ionization chamber 208 along the source axis 124, thereby intensifying the electron density available for EI ionization of analytes in the ionization chamber 208.

To reflect electrons back into the ionization chamber 208, a voltage of relatively high magnitude may be applied to the first lens element 250. This may result in the creation of ions generally in the region between the first lens element 250 and the extractor 248, which may be referred to as an ion trapping region. In comparison to the ionization chamber 208, the energy in this region is low and hence ions created in this region may have undesirably low ion energies. Consequently, these ions are subject to becoming trapped in this region. These ions may be referred to herein as "low energy" or "lower energy" or "trapped" ions, which in the present context refers to ions having energies low enough to be capable of being trapped in the trapping region under the operating conditions contemplated for the ion source 100. By comparison, "high energy" or "higher energy" or "non-trapped" ions, typically those produced in the ionization chamber 208, are capable of penetrating the lens assembly 120 and entering the downstream ion processing device. Ion trapping may lead to undesirable space charge and ion current instabilities, consequently resulting in undesirable erratic performance.

The second lens element 252 is provided to substantially reduce or eliminate ion trapping in the region between the second lens element 252 and the extractor 248. The voltage set on the second lens element 252 may be more positive than the voltage set on the first lens element 250. Consequently, the second lens element 252 reflects the low energy ions back toward the first lens element 250, and these ions then collide with the first lens element 250 and are neutralized. In addition, the first lens element 250 may be positioned as close as practicable to the extractor 248 to minimize ion trapping in the trapping region.

Figure 3:
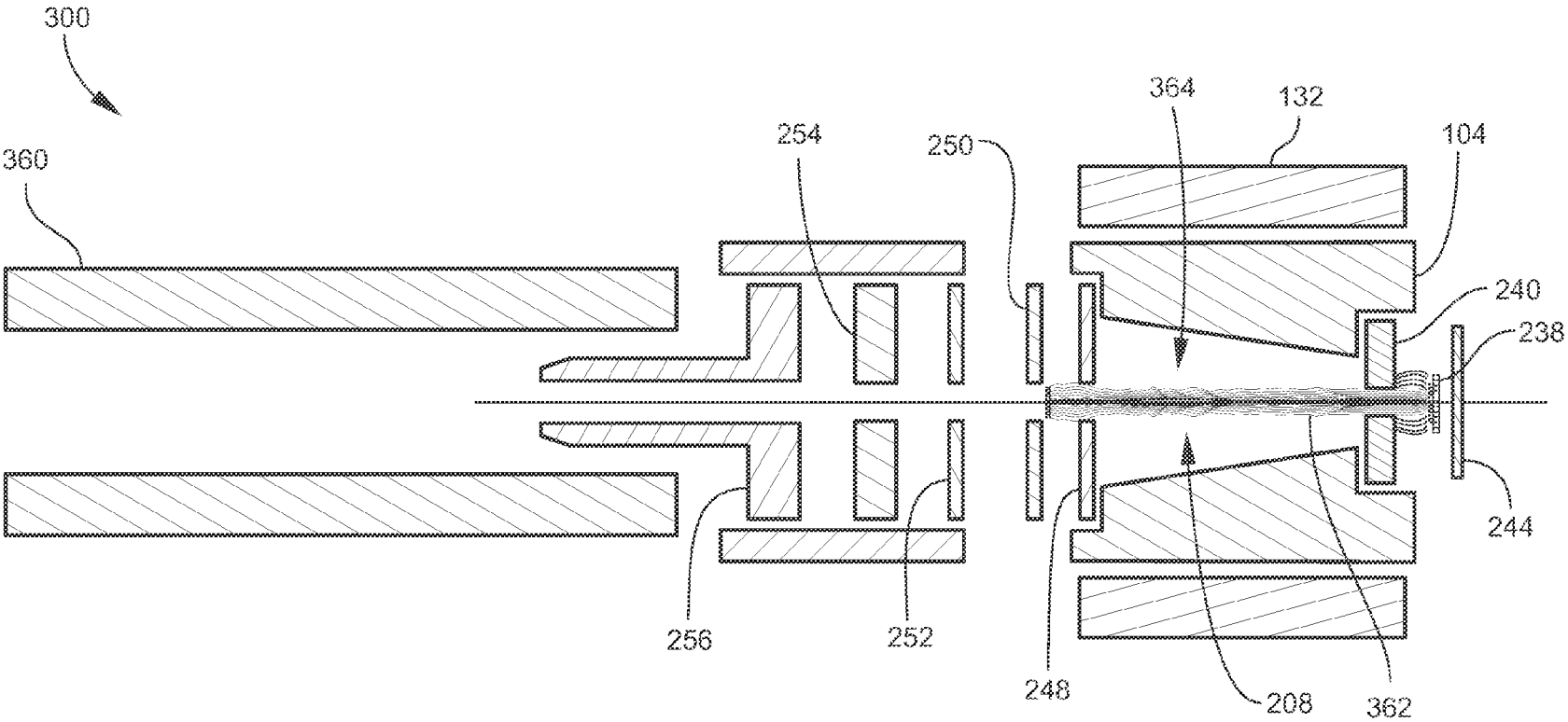
FIG. 3 is a model of the ion source generated by ion simulation software.

FIG. 3 is a model of an ion source 300 generated by ion simulation software. The model corresponds to a cross-sectional side view of the ion source 300. The ion source 300 is generally similar to the ion source 100 described above and illustrated in FIGS. 1 and 2, and accordingly like components are designated by like reference numerals. The model includes a radio frequency (RF) quadrupole mass filter 360 positioned on-axis with the ion source 300 just downstream of the exit lens element 256. FIG. 3 shows an intense electron beam 362 concentrated along the source axis in which electrons are reflected back and forth between the cathode 238 and the first lens element 250. In this simulation the magnetic field strength was 750 gauss. In practice, stronger or weaker magnetic fields may be employed.

FIG. 3 also illustrates an embodiment in which at least a portion 364 of the ionization chamber 208 (such as a portion defined by an inside surface or surfaces of the body 104) is tapered or conical, diverging in the direction of the lens assembly 120. That is, the cross-sectional area of the ionization chamber 208 gradually increases in the direction of the lens assembly 120. This varying geometry subtly attenuates the electrical field, which may cause ions to travel preferentially in the direction of the lens assembly 120 and succeeding ion processing device.

Figure 4:
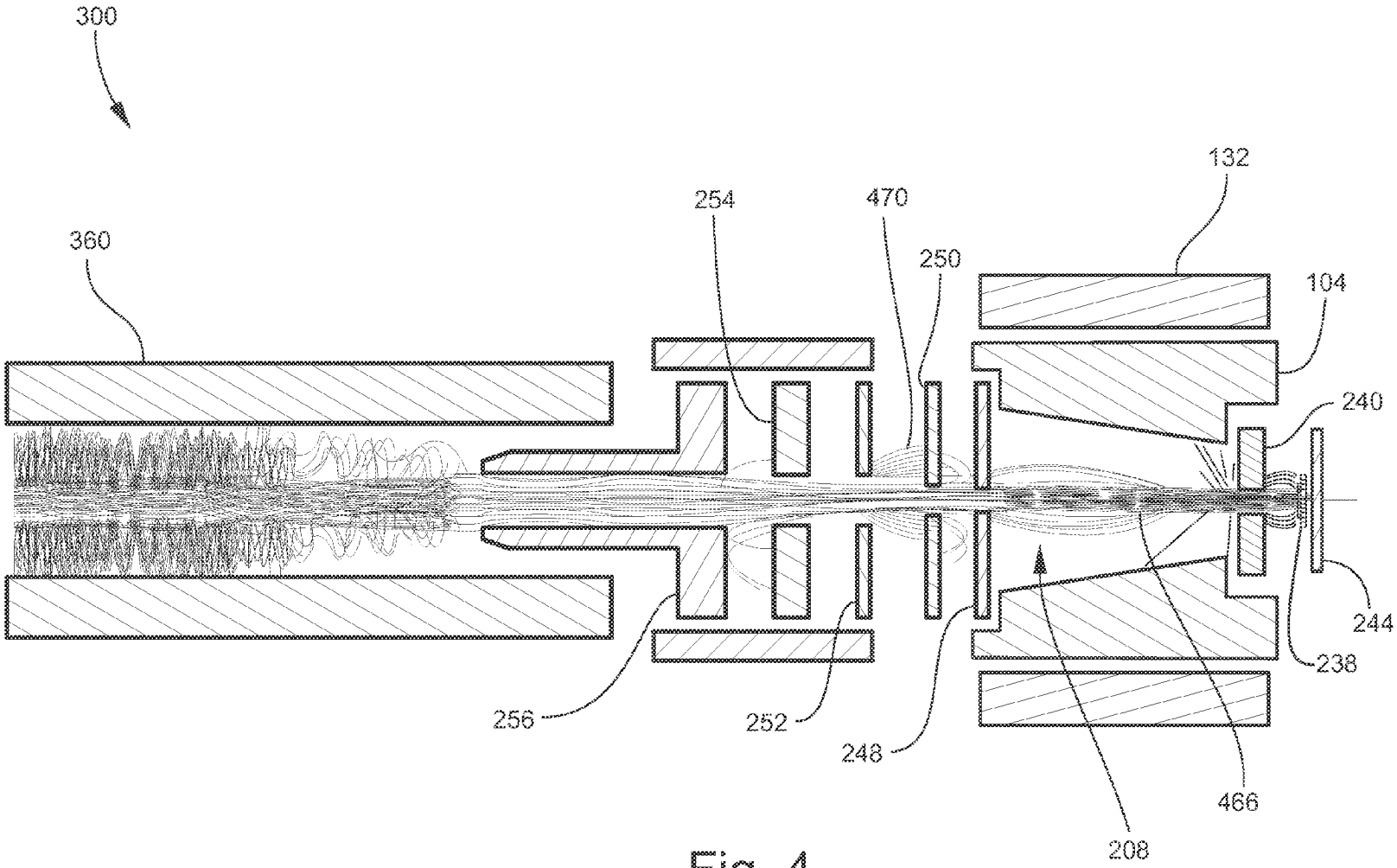
FIG. 4 is the same model as FIG. 3, but showing the ion trajectories, including an ion beam constrained along the source axis.
Figure 5:
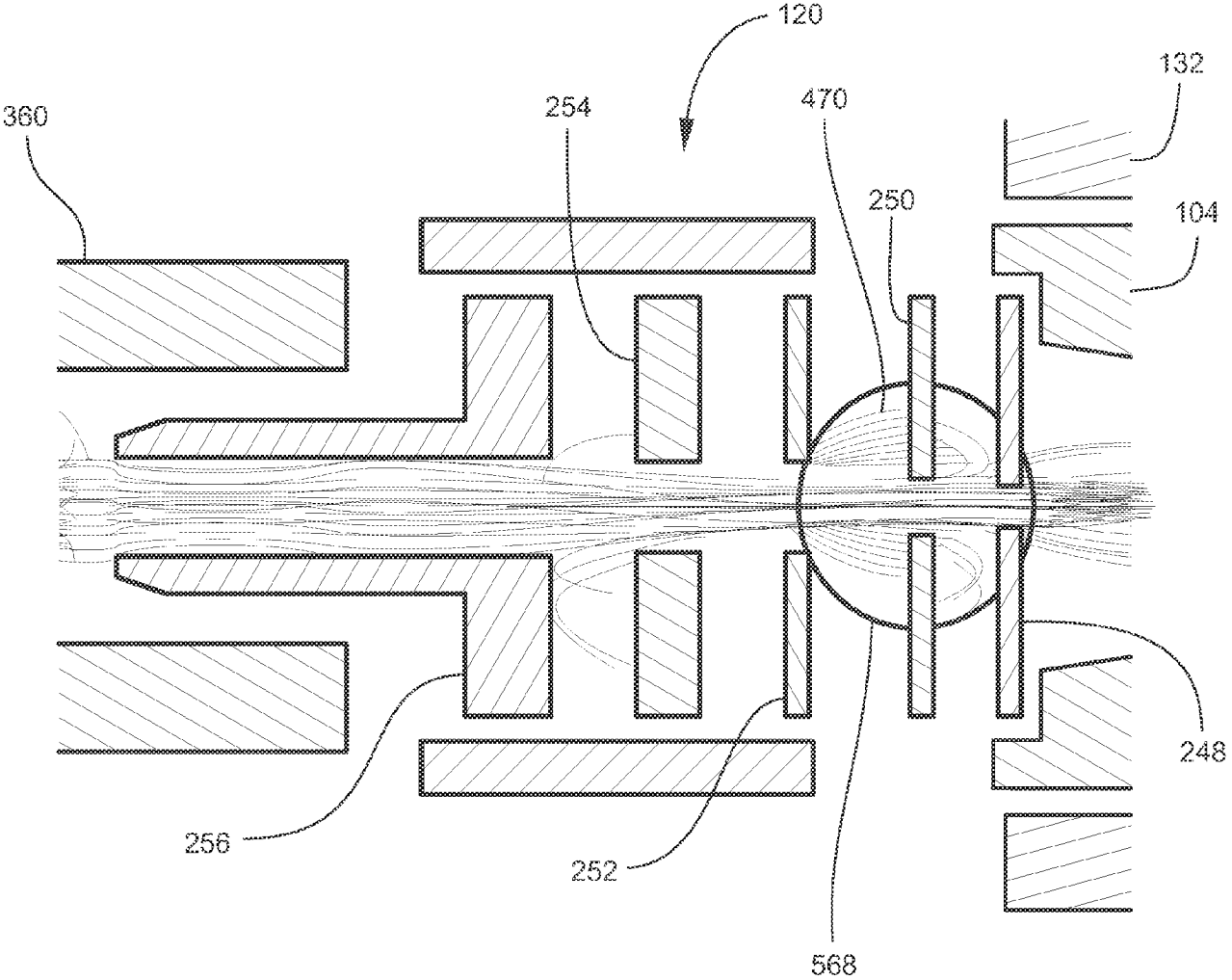
FIG. 5 is a closer view of the region around the lens assembly.

FIG. 4 is the same model as FIG. 3, but showing the ion trajectories, including an ion beam 466 constrained along the source axis. FIG. 5 is a closer view of the region around the lens assembly 120. The ion trapping region is indicated by a circle 568. Low energy ions 470 are shown in FIGS. 4 and 5 being reflected from the second lens element 252 and colliding with the first lens element 250. FIGS. 4 and 5 demonstrate that ion sources disclosed herein are capable of significantly reducing or eliminating ion trapping while maintaining highly efficient transmission of higher energy ions created in the ion volume of the ion source. It will be noted that while the ion source 300 in FIGS. 3-5 was modeled using the conical ion volume geometry, other models were simulated using the straight-bore (constant inside diameter) geometry such as shown in FIG. 2 and produced similar results.

Figure 6:
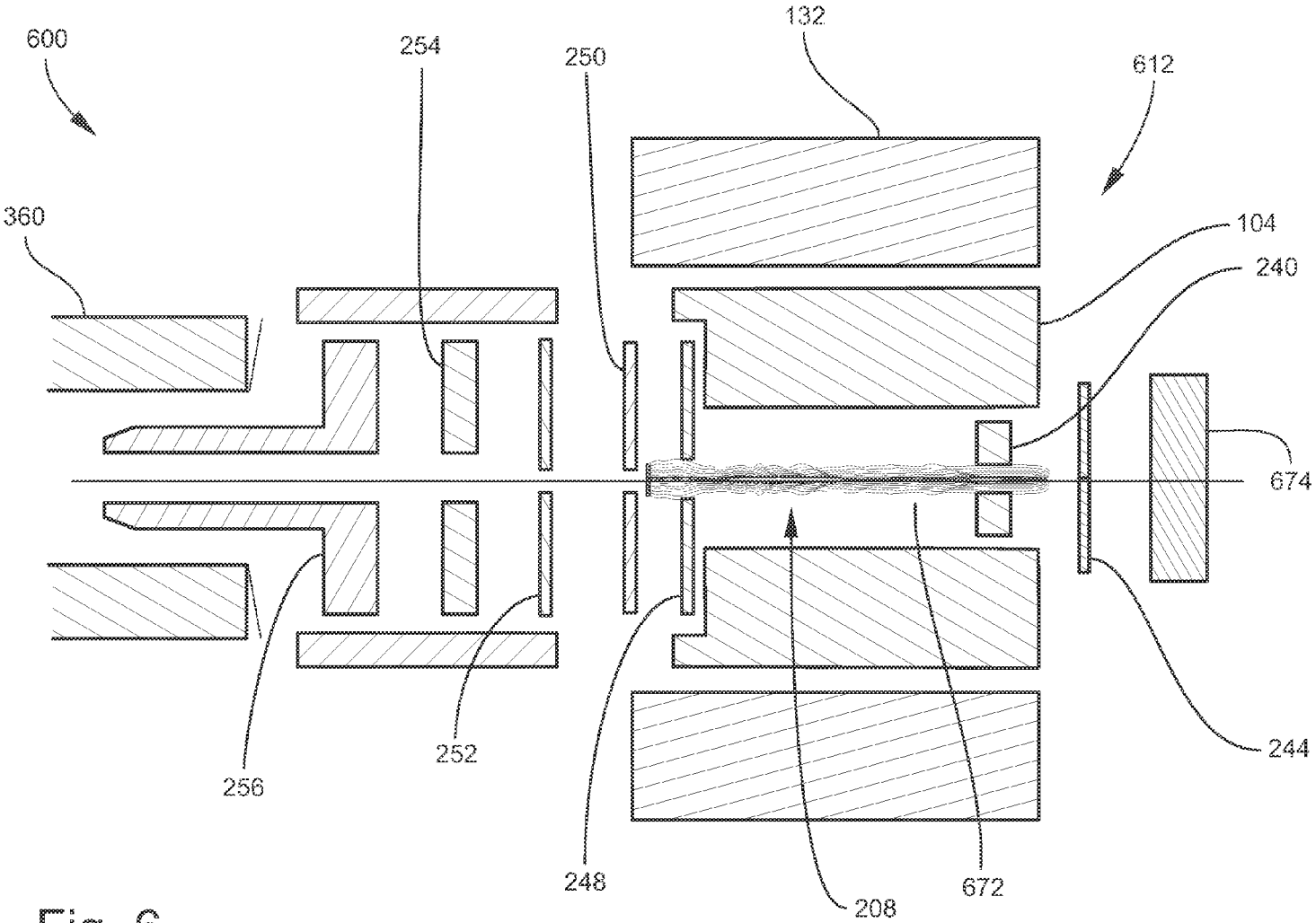
FIG. 6 is another model of the ion source generated by ion simulation software.

In another embodiment, the axial magnetic field may be modified to shape the electron beam and subsequently produced ion beam in a desired manner. This may be achieved, for example, by modifying the configuration of the magnet assembly. FIG. 6 is another model of an ion source 600 generated by ion simulation software, showing an axial electron beam 672 and a magnet assembly 612 according to another embodiment. In addition to magnets positioned radially relative to the source axis (radial magnets 132), the magnet assembly 612 includes a rear or on-axis magnet 674. The on-axis magnet 674 is positioned on the source axis outside the ionization chamber 208, on the side on the electron reflector 244 opposite to the ionization chamber 208. In this example, the on-axis magnet 674 is disk-shaped and the source axis passes through its center. With the addition of the on-axis magnet 674, the electron beam 672 is more focused at the electron source end and gradually expands or diverges in the direction of the lens assembly 120. Expanding the envelope of the electron beam 672 creates a larger ionization region, which may improve the ionization probability. This may be useful for addressing the adverse effects of space charge on the ionization process.

Figure 7:
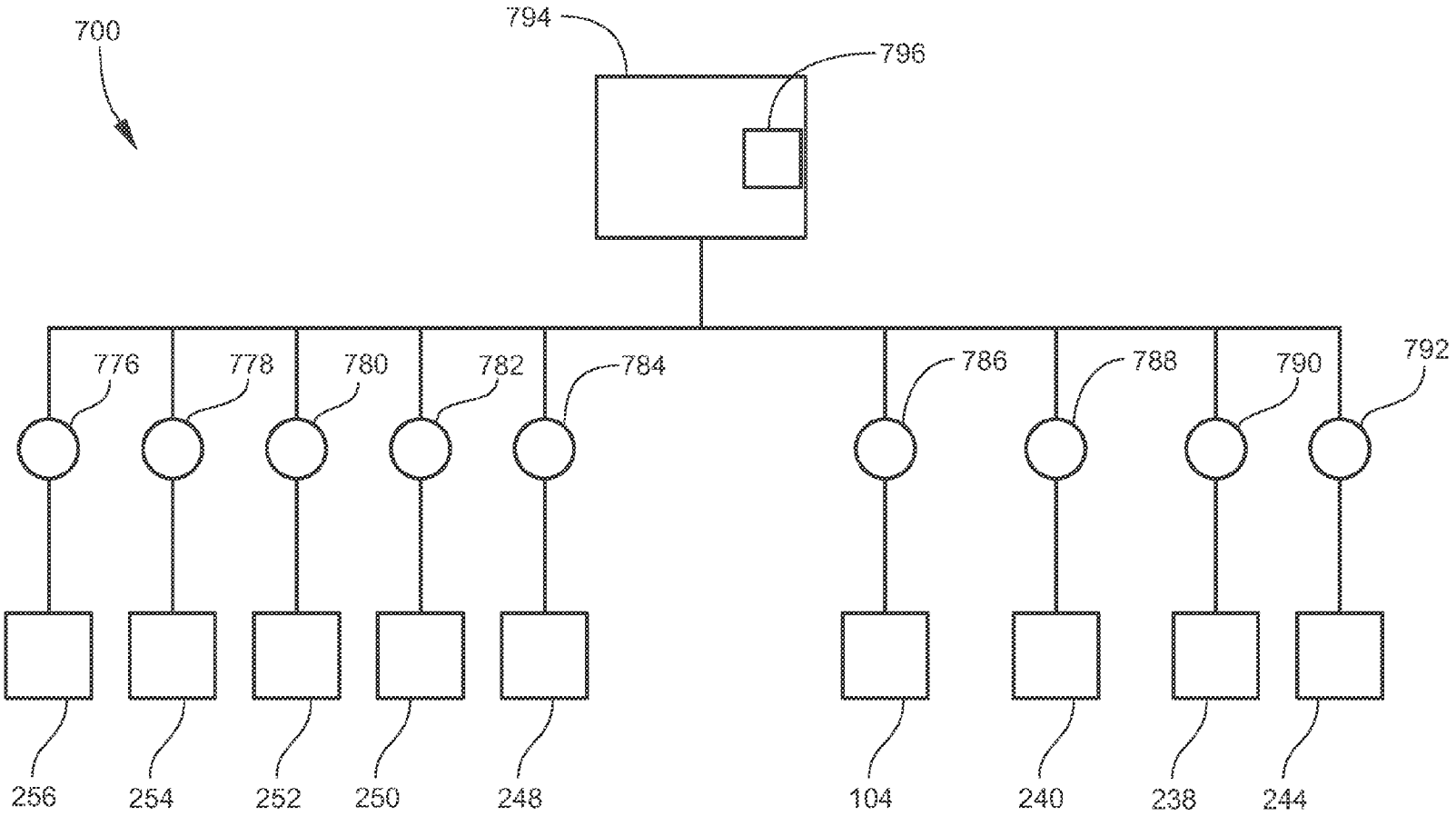
FIG. 7 is a schematic view of an example of hardware that may be provided with the ion source.

FIG. 7 is a schematic view of an example of hardware or electronics 700 that may be provided with an ion source as disclosed herein. Individual voltages applied to various components of the ion source are depicted as respective voltage sources 776-792 (which may collectively be referred to herein as a power supply or voltage source). In some embodiments, one or more voltages 786 may be applied to one or more conductive elements of the body 104. The voltage sources 776-792 are shown is being in signal communication with a controller 794 (e.g., an electronic processor-based controller or computer) to demonstrate that parameters of one or more of the voltage sources 776-792 may be controlled by the controller 794. The parameters may include, for example, settings and adjustments of voltage magnitudes; on/off states, timing and duration of applied voltages; coordination or synchronization of application of voltages to two or more of the voltage sources 776-792; etc. The controller 794 may include a computer-readable medium or software 796 for implementing programmed control of the voltage sources 776-792. In some embodiments the controller 794 may implement (e.g., utilizing firmware and/or software), in whole or in part, one or more of the methods disclosed herein.

In some embodiments, when initiating electron emission the "initial" electron energy may be set up as the potential difference between the thermionic cathode 238 and the ion repeller 240. This potential difference may be maintained at a desired fixed value as the voltage on the cathode 238 or ion repeller 240 changes, by adjusting the voltage on the other component. For example, the ion repeller 240 may be ramped and optimized white still maintaining proper electron energy offset, by adjusting the voltage on the cathode 238 such that it tracks the voltage on the electron reflector 244. Additionally, the voltage on the first tens element 250 may track the cathode voltage to optimize the electron reflecting function of the first lens element 250. The tracking functions may be implemented, for example, by the controller 794 schematically depicted in FIG. 7. As a default operation, the controller 794 may read the cathode voltage and apply the same value to the first lens element 250. To further allow for refinement in the optimization of the first lens element 250, an additional applied offset voltage may be ramped and summed in with the default applied cathode matching voltage, i.e., $V_{FIRST\ LENS\ ELEMENT}=V_{CATHODE}+V_{OFFSET}$. The application of the offset voltage may provide stronger reflection of electrons at the first lens element 250 to minimize incursion of the electrons into the ion trapping region between the first lens element 250 and the extractor 248, thereby further increasing the amount of the more viable high energy ions and reducing the amount of the undesirable low energy ions. Similarly, ramping electron energy varies the cathode voltage, and the voltage applied to the first lens element 250 may track the ramping cathode voltage as well.

In some applications, it may be desirable to reduce or eliminate the effects of electron space charge that develops in the ion source. For example, space charge effects may be significant enough to cause the electron beam to modulate uncontrollably thus adversely affecting the stability of the ion beam. To address this, in some embodiments a periodic voltage may be applied to one or more of the conductive elements of the electron source 116, lens assembly 120, and/or body 104. The periodic voltage may be a periodic DC pulse (with pulse width, period and amplitude empirically optimized) or a high-frequency (e.g., RF) potential. The periodic voltage may discharge any unwanted surface charge build up resulting from increasing levels of contamination. Alternatively, the electron beam may be gated to alleviate space charge build up, such as by employing appropriate electron optics to periodically deflect the electron beam away from the source axis. In some embodiments, space charge effects may be addressed by implementing techniques disclosed in U.S. Pat. No. 7,291,845, the entire content of which is incorporated by reference herein.

Figure 8:
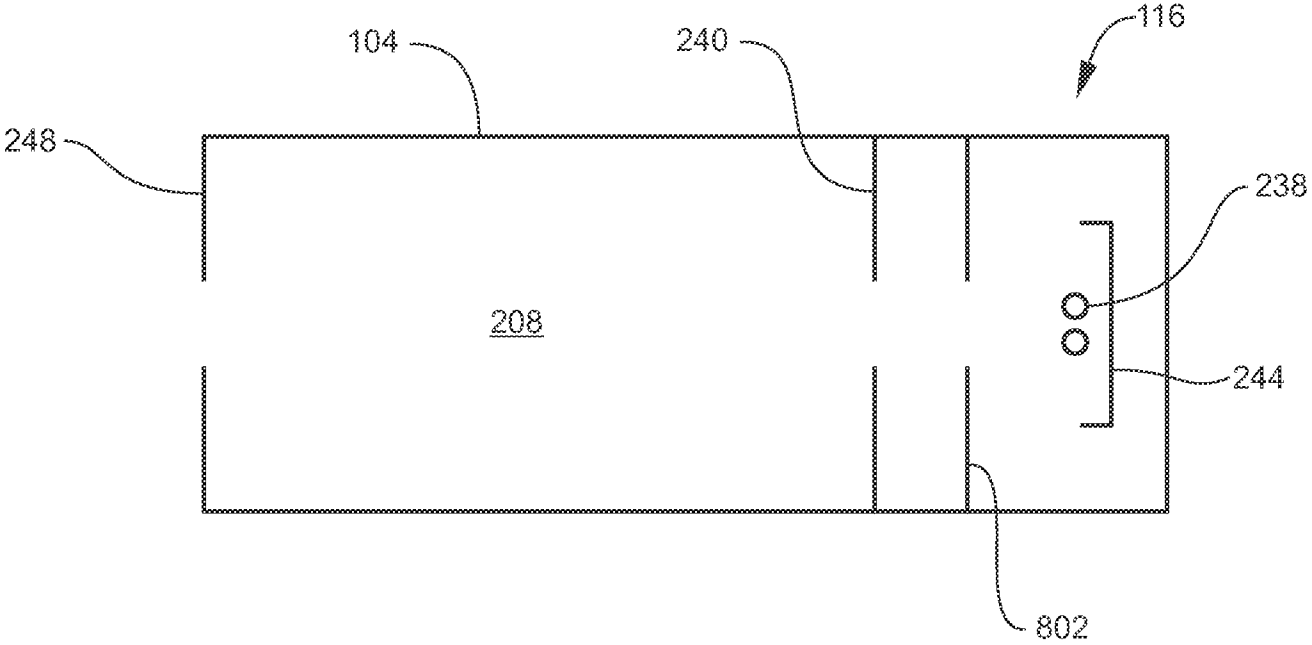
FIG. 8 is a schematic view of a portion of the ion source illustrated in FIGS. 1 and 2 according to another embodiment.

FIG. 8 is a schematic view of a portion of the ion source 100 illustrated in FIGS. 1 and 2 according to another embodiment. In this embodiment, an additional electrode (or electron extractor) 802 is added to the electron source 116 between the cathode (filament) 238 and the ion repeller 240. By applying an appropriate voltage to the electron extractor 802, the electron extractor 802 may be utilized to tune the electric field conditions in the electron source 116, particularly when operating at low electron energy (e.g., 9 eV to 25 eV). For example, the electron extractor 802 may assist in drawing electrons away from the cathode 238 and toward the ionization chamber 208, and keeping the potential difference between the source body 104 and ion repeller 240 low.

Figure 9:
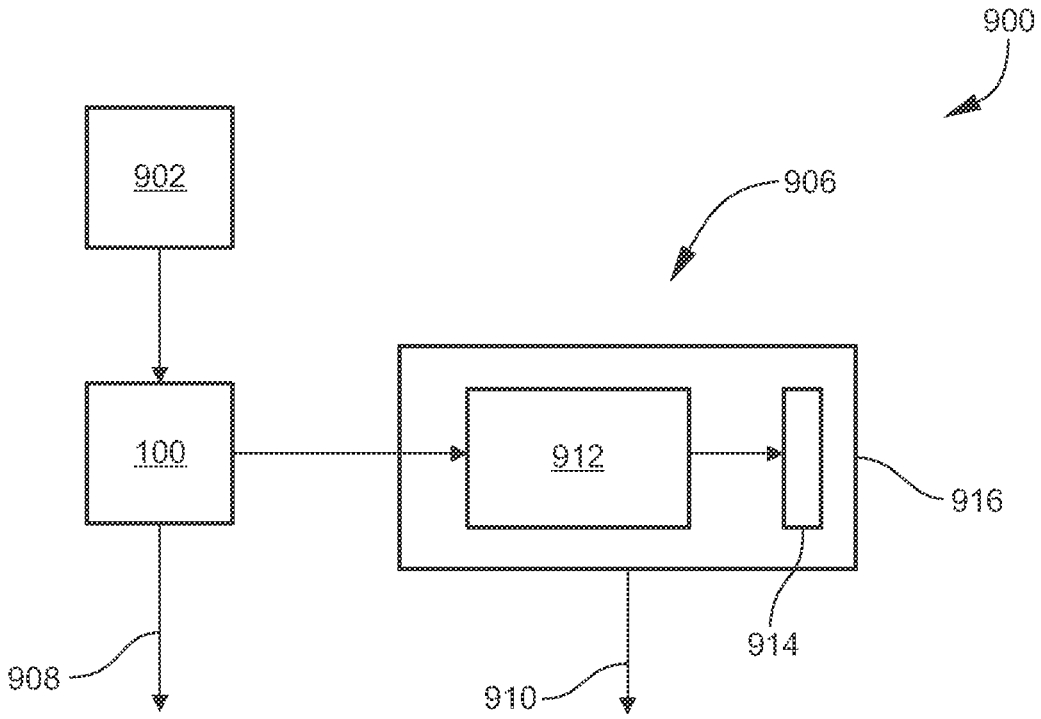
FIG. 9 is a schematic view of an example of a mass spectrometry (MS) system in which an ion source as disclosed herein may be provided.

FIG. 9 is a schematic view of an example of a mass spectrometry (MS) system 900 in which an ion source 100 as disclosed herein may be provided. The MS system 900 generally includes a sample source 902, the ion source 100, a mass spectrometer (MS) 906, and a vacuum system for maintaining the interiors of the ion source 100 and the MS 906 at controlled, sub-atmospheric pressure levels. The vacuum system is schematically depicted by vacuum lines 908 and 910 leading from the ion source 100 and the MS 906, respectively. The vacuum lines 908 and 910 are schematically representative of one or more vacuum-generating pumps and associated plumbing and other components appreciated by persons skilled in the art. It is also appreciated that one or more other types of ion processing devices (not shown) may be provided between the ion source 100 and the MS 906. The structure and operation of various types of sample sources, spectrometers, and associated components are generally understood by persons skilled in the art, and thus will be described only briefly as necessary for understanding the presently disclosed subject matter. In practice, the ion source 100 may be integrated with the MS 906 or otherwise considered as the front end or inlet of the MS 906, and thus in some embodiments may be considered as a component of the MS 906.

The sample source 902 may be any device or system for supplying a sample to be analyzed to the ion source 100. The sample may be provided in a gas-phase or vapor form that flows from the sample source 902 into the ion source 100. In hyphenated systems such as gas chromatography-mass spectrometry (GC-MS) systems, the sample source 902 may be a GC system, in which case an analytical column of the GC system is interfaced with the ion source 100 through suitable hardware.

The MS 906 may generally include a mass analyzer 912 and an ion detector 914 enclosed in a housing 916. The vacuum line 910 maintains the interior of the mass analyzer 912 at very low (vacuum) pressure. In some embodiments, the mass analyzer 912 pressure ranges from $10^{-4}$ to $10^{-9}$ Torr. The vacuum line 910 may also remove any residual non-analytical neutral molecules from the MS 906. The mass analyzer 912 may be any device configured for separating, sorting or filtering analyte ions on the basis of their respective m/z ratios. Examples of mass analyzers include, but are not limited to, multipole electrode structures (e.g., quadrupole mass filters, ion traps, etc.), time-of-flight (TOF) analyzers, and ion cyclotron resonance (ICR) traps. The mass analyzer 912 may include a system of more than one mass analyzer, particularly when ion fragmentation analysis is desired. As examples, the mass analyzer 912 may be a tandem MS or $MS^n$ system, as appreciated by persons skilled in the art. As another example, the mass analyzer 912 may include a mass filter followed by a collision cell, which in turn is followed by a mass filter (e.g., a triple-quad or QQQ system) or a TOF device (e.g., a qTOF system). The ion detector 914 may be any device configured for collecting and measuring the flux (or current) of mass-discriminated ions outputted from the mass analyzer 912. Examples of ion detectors 914 include, but are not limited to, electron multipliers, photomultipliers, and Faraday cups.

Axial EI sources as disclosed herein may in some embodiments be operated at either high electron energies or low electron energies. The energy of the electron beam may be adjusted by adjusting the voltage applied to the filament, thereby adjusting the current through the filament. In some embodiments, the electron beam may be adjusted over a range from 9 eV to 150 eV. Electron energies less than 70 eV, for example in a range from 9 eV to 25 eV, may be considered as being within the regime of soft ionization. Axial EI sources as disclosed herein are capable of effectively implementing EI over these ranges of electron energies. Even at very low energies, the EI sources are capable of producing an electron beam with an intensity and ionization yield sufficient for many experiments. These axial EI sources are thus able to implement hard ionization or soft ionization, and to switch between hard ionization and soft ionization (including during the same experiment), as desired or needed for optimizing the ionization and mass analysis processes for a given analyte or set of analytes. The axial EI sources may thus be employed in many cases in which conventionally EI is discarded in favor of a conventional soft ionization process such as chemical ionization (CI). Accordingly, axial EI sources as disclosed herein may be more universal ionization devices in comparison to other devices such as CI sources and conventional EI sources. For example, the axial EI source may be operated at a low electron energy that favors a desired ionization pathway, such as the formation of a molecular ion or other high mass ion. Methods relating to the operation of an axial EI source at low electron energies are disclosed in a U.S. patent application Ser. No. 13/925,470 titled "ELECTRON IONIZATION (EI) UTILIZING DIFFERENT EI ENERGIES," filed concurrently with the present application, the entire content of which is incorporated by reference herein.

It will be understood that while examples of the ion source are described above primarily in the context of EI, the ion source taught herein may additionally or alternatively be configured for chemical ionization (CI), which is a well-known technique that also utilizes an electron beam. In the case of CI, the ion source may include an inlet for admitting a reagent gas into the ionization chamber.

Exemplary Embodiments

Exemplary embodiments provided in accordance with the presently disclosed subject matter include, but are not limited to, the following:

1. An ion source, comprising: a body comprising an ionization chamber and a sample inlet leading into the ionization chamber, the ionization chamber comprising a first end and a second end, and having a length along a source axis from the first end to the second end; a magnet assembly surrounding the body and configured for generating an axial magnetic field in the ionization chamber; an electron source positioned at the first end and comprising a thermionic cathode and an electron reflector, the electron source configured for accelerating an electron beam through the ionization chamber along the source axis; and a lens assembly comprising an extractor positioned at the second end, a first lens element outside the ionization chamber and spaced from the extractor along the source axis, and a second lens element spaced from the first lens element along the source axis, wherein the extractor is configured for directing an ion beam out from the ionization chamber along the source axis, the first lens element is configured for reflecting the electron beam toward the electron source, and the second lens element is configured for transmitting higher energy ions while reflecting lower energy ions toward the first lens element.

2. The ion source of embodiment 1, wherein the ionization chamber has a cross-sectional area that is constant along the length, or a cross-sectional area that increases along at least a portion of the length.

3. The ion source of embodiment 1 or 2, wherein the magnet assembly comprises a plurality of magnets circumferentially spaced from each other about the source axis.

4. The ion source of embodiment 3, wherein the sample inlet is positioned between two of the magnets.

5. The ion source of embodiment 3 or 4, wherein the magnet assembly comprises an on-axis magnet positioned on the source axis outside the ionization chamber and configured for modifying the axial magnetic field such that the electron beam diverges in a direction toward the extractor.

6. The ion source of any of embodiments 1-5, comprising an ion repeller positioned at the first end between the cathode and the extractor.

7. The ion source of any of embodiments 1-6, wherein the lens assembly comprises an exit lens spaced from the second lens element and configured for directing the ion beam into an ion processing device along the source axis.

8. The ion source of any of embodiments 1-7, comprising a voltage source in signal communication with the electron source and the lens assembly, and a controller configured for controlling an operation of the voltage source selected from the group consisting of: adjusting a voltage applied to the cathode; maintaining a fixed potential difference between the cathode and an ion repeller positioned at the first end between the cathode and the extractor, while adjusting a voltage applied to the cathode; adjusting a voltage applied to the first lens element based on an adjustment to a voltage applied to the cathode; setting voltages applied to the cathode and the first lens element to respective values sufficient for maintaining reflection of the electron beam between the cathode and the first lens element; setting voltages applied to the cathode and the first lens element to respective values sufficient for maintaining reflection of the electron beam between the cathode and the first lens element, and adding a voltage offset to the first lens element relative to the cathode to increase reflection of the electron beam from the first lens element; setting a voltage applied to the second lens element to a value sufficient for accelerating ions trapped between the second lens element and the extractor toward the first lens element; applying a voltage pulse to a conductive element of the electron source; applying a voltage pulse to a conductive element of the lens assembly; applying a voltage pulse to the body; gating the electron beam; and two or more of the foregoing.

9. The ion source of any of embodiments 1-8, comprising an ion repeller between the cathode and the ionization chamber, and an electron extractor between the cathode and the ion repeller.

10. An ion processing system, comprising: the ion source of any of embodiments 1-9; and an ion processing device communicating with the lens assembly.

11. The ion processing system of embodiment 10, wherein the ion processing device is selected from the group consisting of an ion guide, an ion trap, a mass filter, a collision cell, and a mass analyzer.

12. The ion processing system of embodiment 10, wherein the ion processing device comprises a mass analyzer, and further comprising an ion detector communicating with the mass analyzer.

13. A method for performing electron ionization, the method comprising: directing electrons as an electron beam from an electron source through an ionization chamber having a length along a source axis between the electron source and a lens assembly; focusing the electron beam along the source axis by applying an axial magnetic field to the ionization chamber; reflecting the electrons back and forth along the source axis between the electron source and the lens assembly; producing ions by directing a sample material into the ionization chamber toward the electron beam, wherein the ions are focused into an ion beam along the source axis; transmitting the ions through the lens assembly along the source axis; and reflecting ions trapped in the lens assembly to prevent the trapped ions from exiting the lens assembly, while transmitting non-trapped ions out from the lens assembly.

14. The method of embodiment 13, comprising directing the sample material between two magnets utilized in applying the axial magnetic field.

15. The method of embodiment 13 or 14, wherein focusing the electrons comprises utilizing a plurality of magnets circumferentially spaced from each other about the source axis.

16. The method of any of embodiments 13-15, wherein focusing the electrons is done such that the electron beam diverges in a direction toward the extractor.

17. The method of any of embodiments 13-16, wherein focusing the electrons comprises utilizing a plurality of magnets circumferentially spaced from each other about the source axis, and an on-axis magnet positioned on the source axis outside the ionization chamber.

18. The method of any of embodiments 13-17, wherein producing the electrons is done by applying a voltage to a cathode, and further comprising adjusting an energy of the electrons by adjusting the voltage.

19. The method of embodiment 18, comprising, while adjusting the voltage on the cathode, adjusting a voltage on an ion repeller positioned between the cathode and the lens assembly to maintain a fixed potential difference between the cathode and the ion repeller.

20. The method of embodiment 18 or 19, comprising applying a voltage to a lens element of the lens assembly to reflect the electron beam back into the ionization chamber and, while adjusting the voltage on the cathode, adjusting the voltage on the lens element by an equal amount.

21. The method of any of embodiments 18-20, wherein producing the electrons is done by applying a voltage to a cathode, and further comprising applying a voltage to a lens element of the lens assembly to reflect the electron beam back into the ionization chamber.

22. The method of embodiment 21, comprising setting voltages applied to the cathode and the lens element to respective values sufficient for maintaining reflection of the electron beam between the cathode and the lens element.

23. The method of embodiment 22, comprising setting the respective voltages applied to the cathode and the lens element to equal values, or increasing the voltage applied to the lens element by an offset amount relative to the voltage applied to the cathode to increase reflection at the lens element.

24. The method of any of embodiments 13-23, comprising applying a voltage to an extractor of the lens assembly to transmit the ions from the ionization chamber into the lens assembly.

25. The method of embodiment 24, comprising applying a voltage to a first lens element of the lens assembly positioned outside the ionization chamber to reflect the electron beam through the extractor and into the ionization chamber.

26. The method of embodiment 25, comprising applying a voltage to a second lens element of the lens assembly to reflect the trapped ions into collision with the first lens element.

27. The method of any of embodiments 13-26, comprising applying a voltage to a lens element of the lens assembly to reflect the trapped ions into collision with another lens element of the lens assembly.

28. The method of any of embodiments 13-27, comprising performing a pulsing step selected from the group consisting of: applying a voltage pulse to a conductive element of the electron source; applying a voltage pulse to a conductive element of the lens assembly; applying a voltage pulse to a body defining at least a portion of the ionization chamber; gating the electron beam; and two or more of the foregoing.

29. The method of any of embodiments 13-28, comprising emitting electrons from a cathode of the electron source, and drawing the emitted electrons away from the cathode by applying a voltage to an electron extractor of the electron source.

30. The method of embodiment 29, comprising repelling ions away from the electron source by applying a voltage to an ion repeller positioned between the electron source and the ionization chamber.

31. The method of any of embodiments 13-30, comprising transmitting the ions through the lens assembly and into an ion processing device comprising an entrance on the source axis.

32. The method of any of embodiments 13-31, comprising, prior to directing the sample material into the ionization chamber, outputting the sample material from a gas chromatograph.

It will be understood that the system controller 794 schematically depicted in FIG. 7 may represent one or more modules configured for controlling, monitoring, timing, synchronizing and/or coordinating various functional aspects of the ion source. The system controller 794 may also represent one or more modules configured for controlling functions or components of an associated spectrometry system, including, for example, receiving the ion measurement signals and performing other tasks relating to data acquisition and signal analysis as necessary to generate a mass spectrum characterizing the sample under analysis.

For all such purposes, the controller 794 may include a computer-readable medium that includes instructions for performing any of the methods disclosed herein. The controller 794 is schematically illustrated as being in signal communication with various components of the ion source via wired or wireless communication links. Also for these purposes, the controller 794 may include one or more types of hardware, firmware and/or software, as well as one or more memories and databases. The controller 794 typically includes a main electronic processor providing overall control, and may include one or more electronic processors configured for dedicated control operations or specific signal processing tasks. The system controller 794 may also schematically represent all voltage sources not specifically shown, as well as timing controllers, clocks, frequency/waveform generators and the like as needed for applying voltages to various components. The controller 794 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The controller 794 may include an operating system (e.g., Microsoft Windows® software) for controlling and managing various functions of the controller 794.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion source, comprising:

a body comprising an ionization chamber and a sample inlet leading into the ionization chamber, the ionization chamber comprising a first end and a second end, and having a length along a source axis from the first end to the second end;

a magnet assembly surrounding the body and configured for generating an axial magnetic field in the ionization chamber;

an electron source positioned at the first end and comprising a thermionic cathode and an electron reflector, the electron source configured for accelerating an electron beam through the ionization chamber along the source axis; and a lens assembly comprising an extractor positioned at the second end, a first lens element outside the ionization chamber and spaced from the extractor along the source axis, and a second lens element spaced from the first lens element along the source axis, wherein the extractor is configured for directing an ion beam out from the ionization chamber along the source axis, the first lens element is configured for reflecting the electron beam toward the electron source, and the second lens element is configured for transmitting higher energy ions while reflecting lower energy ions toward the first lens element.

2. The ion source of claim 1, wherein the ionization chamber has a cross-sectional area that is constant along the length, or a cross-sectional area that increases along at least a portion of the length.

3. The ion source of claim 1, wherein the magnet assembly comprises a plurality of magnets circumferentially spaced from each other about the source axis.

4. The ion source of claim 3, wherein the magnet assembly comprises an on-axis magnet positioned on the source axis outside the ionization chamber and configured for modifying the axial magnetic field such that the electron beam diverges in a direction toward the extractor.

5. The ion source of claim 1, comprising an ion repeller positioned at the first end between the cathode and the extractor.

6. The ion source of claim 1, comprising a voltage source in signal communication with the electron source and the lens assembly, and a controller configured for controlling an operation of the voltage source selected from the group consisting of:

adjusting a voltage applied to the cathode;

maintaining a fixed potential difference between the cathode and an ion repeller positioned at the first end between the cathode and the extractor, while adjusting a voltage applied to the cathode;

adjusting a voltage applied to the first lens element based on an adjustment to a voltage applied to the cathode;

setting voltages applied to the cathode and the first lens element to respective values sufficient for maintaining reflection of the electron beam between the cathode and the first lens element;

setting voltages applied to the cathode and the first lens element to respective values sufficient for maintaining reflection of the electron beam between the cathode and the first lens element, and adding a voltage offset to the first lens element relative to the cathode to increase reflection of the electron beam from the first lens element;

setting a voltage applied to the second lens element to a value sufficient for accelerating ions trapped between the second lens element and the extractor toward the first lens element;

applying a voltage pulse to a conductive element of the electron source;

applying a voltage pulse to a conductive element of the lens assembly;

applying a voltage pulse to the body;

gating the electron beam; and two or more of the foregoing.

7. A method for performing electron ionization, the method comprising:

directing electrons as an electron beam from an electron source through an ionization chamber having a length along a source axis between the electron source and a lens assembly;

focusing the electron beam along the source axis by applying an axial magnetic field to the ionization chamber;

reflecting the electrons back and forth along the source axis between the electron source and the lens assembly;

producing ions by directing a sample material into the ionization chamber toward the electron beam, wherein the ions are focused into an ion beam along the source axis;

transmitting the ions through the lens assembly along the source axis; and reflecting ions trapped in the lens assembly to prevent the trapped ions from exiting the lens assembly, while transmitting non-trapped ions out from the lens assembly.

8. The method of claim 7, wherein focusing the electrons is done such that the electron beam diverges in a direction toward the extractor.

9. The method of claim 7, wherein focusing the electrons comprises utilizing a plurality of magnets circumferentially spaced from each other about the source axis, and an on-axis magnet positioned on the source axis outside the ionization chamber.

10. The method of claim 7, wherein producing the electrons is done by applying a voltage to a cathode, and further comprising adjusting an energy of the electrons by adjusting the voltage.

11. The method of claim 10, comprising, while adjusting the voltage on the cathode, adjusting a voltage on an ion repeller positioned between the cathode and the lens assembly to maintain a fixed potential difference between the cathode and the ion repeller.

12. The method of claim 10, comprising applying a voltage to a lens element of the lens assembly to reflect the electron beam back into the ionization chamber and, while adjusting the voltage on the cathode, adjusting the voltage on the lens element by an equal amount.

13. The method of claim 7, wherein producing the electrons is done by applying a voltage to a cathode, and further comprising applying a voltage to a lens element of the lens assembly to reflect the electron beam back into the ionization chamber.

14. The method of claim 13, comprising setting voltages applied to the cathode and the lens element to respective values sufficient for maintaining reflection of the electron beam between the cathode and the lens element.

15. The method of claim 14, comprising setting the respective voltages applied to the cathode and the lens element to equal values, or increasing the voltage applied to the lens element by an offset amount relative to the voltage applied to the cathode to increase reflection at the lens element.

16. The method of claim 7, comprising applying a voltage to an extractor of the lens assembly to transmit the ions from the ionization chamber into the lens assembly.

17. The method of claim 16, comprising applying a voltage to a first lens element of the lens assembly positioned outside the ionization chamber to reflect the electron beam through the extractor and into the ionization chamber.

18. The method of claim 17, comprising applying a voltage to a second lens element of the lens assembly to reflect the trapped ions into collision with the first lens element.

19. The method of claim 7, comprising applying a voltage to a lens element of the lens assembly to reflect the trapped ions into collision with another lens element of the lens assembly.

20. The method of claim 7, comprising performing a pulsing step selected from the group consisting of: applying a voltage pulse to a conductive element of the electron source; applying a voltage pulse to a conductive element of the lens assembly; applying a voltage pulse to a body defining at least a portion of the ionization chamber; gating the electron beam; and two or more of the foregoing.

* * * * *

UNITED STATES PATENT AND TRADEMARK OFFICE

CERTIFICATE OF CORRECTION

PATENT NO. : 9,117,617 B2
APPLICATION NO. : 13/925623
DATED : August 25, 2015
INVENTOR(S) : Charles William Russ, IV et al.

It is certified that error appears in the above-identified patent and that said Letters Patent is hereby corrected as shown below:

On the title page item 72,

In column 1, in "Inventors", lines 1-2, delete "Loveland, CO" and insert -- Sunnyvale, CA --, therefor.

In column 1, in "Inventors", line 2, delete "Loveland, CO" and insert -- Mountain View, CA --, therefor.

In column 1, in "Inventors", line 3, delete "Loveland, CO" and insert -- Santa Cruz, CA --, therefor.

In the specification

In column 1, line 7, delete "may" and insert -- may be --, therefor.

In column 1, line 21, delete "deter" and insert -- determine --, therefor.

Signed and Sealed this
Tenth Day of May, 2016

Michelle K. Lee

Michelle K. Lee
*Director of the United States Patent and Trademark Office*